US009939214B2

(12) United States Patent
Kamino

(10) Patent No.: US 9,939,214 B2
(45) Date of Patent: Apr. 10, 2018

(54) SCRAPE-OFF TYPE HEAT EXCHANGER

(71) Applicant: NOA CO., LTD., Yamaguchi (JP)

(72) Inventor: Tojo Kamino, Yamaguchi (JP)

(73) Assignee: NOA CO., LTD., Yamaguchi (JP)

( * ) Notice: Subject to any disclaimer, the term of this patent is extended or adjusted under 35 U.S.C. 154(b) by 341 days.

(21) Appl. No.: 14/649,255

(22) PCT Filed: Dec. 4, 2013

(86) PCT No.: PCT/JP2013/082594
§ 371 (c)(1),
(2) Date: Jun. 3, 2015

(87) PCT Pub. No.: WO2014/088032
PCT Pub. Date: Jun. 12, 2014

(65) Prior Publication Data

US 2016/0018170 A1 Jan. 21, 2016

(30) Foreign Application Priority Data

Dec. 5, 2012 (JP) ..... 2012-266215

(51) Int. Cl.
*F28F 17/00* (2006.01)
*F28F 19/00* (2006.01)
(Continued)

(52) U.S. Cl.
CPC ..... *F28F 19/008* (2013.01); *F28D 7/106* (2013.01); *F28F 1/08* (2013.01); *F28G 1/08* (2013.01)

(58) Field of Classification Search
CPC .... F28F 19/008; F28F 1/08; F28F 5/06; F28F 13/125; F28F 1/40; F28D 7/106;
(Continued)

(56) References Cited

U.S. PATENT DOCUMENTS 336,175 A * 2/1886 Tompkins et al. ..... B29C 47/84 165/87
1,966,819 A * 7/1934 Irvin ..... B08B 9/0553 137/1
(Continued)

FOREIGN PATENT DOCUMENTS

EP 0730893 A1 9/1996
JP S56-003889 A 1/1981
(Continued)

OTHER PUBLICATIONS

International Search Report for PCT/JP2013/082594, dated Feb. 25, 2014.

*Primary Examiner* — Jianying Atkisson
*Assistant Examiner* — Jose O Class-Quinones
(74) *Attorney, Agent, or Firm* — Kubotera & Associates, LLC

(57) ABSTRACT

Provided is an inexpensive scrape-off type heat exchanger that is simple in construction, eliminating the need for using a pump for forcibly feeding the process fluid. With the scrape-off type heat exchanger (1), when a suction delivery element (30) which is rotated, while making a reciprocating motion, being closely contacted with an inner wall (200) of the heat transfer tube (20), is traveled from the process fluid inlet part (21) side toward a process fluid outlet part (22), the process fluid is sucked from a process fluid inlet part (21) into the inside of the heat transfer tube (20), and at the same time, the process fluid, which has already been sucked in, passed through the suction delivery element (30), and discharged to the process fluid outlet part (22) side, through the check valves 310, 320, is forced out to the process fluid outlet part (22). In the inside of the heat transfer tube (20), the process fluid is subjected to heat exchange with a heating/cooling medium which flows in between the jacket tube 10 and the heat transfer tube (20). The process fluid attached to the inner wall (200) of the heat transfer tube (20) is scraped off while the scraping part (33) being rotated.

8 Claims, 3 Drawing Sheets

(51) Int. Cl.
*F28G 1/08* (2006.01)
*F28D 7/10* (2006.01)
*F28F 1/08* (2006.01)

(58) Field of Classification Search
CPC ..... F28D 1/0417; B08B 9/043; B08B 9/045; B08B 9/04; B08B 9/055; B08B 9/0551; B08B 9/0553; B01F 15/00051; B01F 15/00058; F28G 1/08; F28G 3/02; F28G 3/10; F28G 3/12
USPC ..... 141/27, 119; 415/71; 416/176; 137/15.07, 242, 244; 165/DIG. 11, 165/DIG. 76, DIG. 77, DIG. 78, DIG. 79, 165/DIG. 8, DIG. 81, DIG. 83, DIG. 9, 165/DIG. 91, DIG. 92; 417/430, 444, 417/459, 488, 546, 552, 555.1, 556
See application file for complete search history.

(56) References Cited

U.S. PATENT DOCUMENTS 2,039,796 A * 5/1936 Hiller ..... F28D 7/106 165/94
2,943,845 A * 7/1960 Jaklitsch ..... F01M 5/005 165/120
3,181,840 A * 5/1965 Rietz ..... B01F 7/00216 366/309
3,890,685 A * 6/1975 Runte ..... B23P 15/26 165/87
5,528,790 A * 6/1996 Curran ..... F28G 1/08 15/104.061
6,085,376 A 7/2000 Antal et al.
2001/0013406 A1 8/2001 Duran
2003/0173070 A1 * 9/2003 Kamino ..... F28D 7/026 165/179
2012/0042461 A1 * 2/2012 Antal ..... B08B 9/057 15/104.05

FOREIGN PATENT DOCUMENTS

JP S57-102578 A 6/1982
JP S60-066992 U 5/1985
JP S61-062789 A 3/1986
JP S61-074782 U 5/1986
JP H03-263598 A 11/1991
JP H10-103895 A 4/1998
JP H10-179074 A 7/1998
JP 2000-121285 A 4/2000
JP 2002-520573 A 7/2002
JP 2008-144994 A 6/2008

* cited by examiner

SCRAPE-OFF TYPE HEAT EXCHANGER

TECHNICAL FIELD

The present invention relates to a scrape-off type heat exchanger that passes a heating/cooling medium in between a tubular jacket and a heat transfer tube that is extended in the jacket, and passes a process fluid into the heat transfer tube to make heat exchange while scraping off the process fluid attached to the inner wall of the heat transfer tube.

BACKGROUND ART

Conventionally, as heat exchangers for handling a fluid, there have been available heat exchangers of tube-type, plate-type, spiral type and other types. Especially as heat exchangers for handling high viscosity fluids or slurry fluids, scrape-off type heat exchangers are used. This is because, in the case where a fluid to be handled is a high viscosity fluid or a slurry fluid, such a fluid often has characteristics as a non-Newton fluid. For example, the viscosity characteristics of process fluids, such as foodstuffs, pharmaceutical agents, cosmetics, and detergents often greatly vary in the whole temperature range.

As an example of scrape-off type heat exchanger that heats or cools such a high viscosity fluid or slurry fluid, there is available a scrape-off type heat exchanger disclosed in the Patent Document 1. In this scrape-off type heat exchanger, there are provided a cylinder through which a processing object is passed, being exposed to the heat transfer face thereof, and a jacket that causes a heating medium or cooling medium to be passed along the outer periphery of the cylinder, with a rotatable center shaft being extended along the center axis of the cylinder, the rotatable center shaft being provided with a scraping blade that can be contacted with the heat transfer face of the cylinder. In addition, with this scrape-off type heat exchanger, as with a conventional scrape-off type heat exchanger, the processing object is forcibly fed from an inlet of the processing object into the cylinder with a pump or other means.

CITATION LIST

Patent Literature

Patent Document 1: Japanese Unexamined Patent Application Publication No. H10-179074

SUMMARY OF INVENTION

However, with such a conventional technology, there are problems that much power is required in order to forcibly scrape off the solid-liquid interface between the heat transfer face and the process fluid as a processing object with a scraping blade for stirring the process fluid, and to pressure feed a high viscosity fluid or a slurry fluid, using a pump, and thus the configuration thereof becomes large-scaled. In addition, there is a problem that, since much power is required, the efficiency must be improved, and if, in order to meet this requirement, the heat transfer area is increased to thereby allow a large quantity of process fluid to be charged, resulting in an extremely expensive scrape-off type heat exchanger.

The present invention has been made in view of such problems that the conventional technology faces, and it is an object of the present invention to provide an inexpensive scrape-off type heat exchanger that eliminates the need for using a pump for forcibly feeding the process fluid, thereby having a simple construction.

Means for Solving the Problem

The subject matters of the present invention to achieve the above object are disclosed in the following respective aspects of the present invention:

[1] A scrape-off type heat exchanger, the scrape-off type heat exchanger passing a heating/cooling medium in between a tubular jacket and a heat transfer tube, the heat transfer tube being extended in the inside of the jacket, and the scrape-off type heat exchanger passing a process fluid through the inside of the heat transfer tube to perform heat exchange between the process fluid and the heating/cooling medium, while scraping off the process fluid attached to an inner wall of the heat transfer tube, including:

a suction delivery element, the suction delivery element being closely contacted with the inner wall of the heat transfer tube, and making a reciprocating motion in the inside of the heat transfer tube, while being rotated, to suck the process fluid into the heat transfer tube and deliver the process fluid from the heat transfer tube, while scraping off the process fluid, the heat transfer tube being a corrugated pipe, having an inner wall with a helical part, the helical part providing a female thread-like spiral geometry, being formed by alternately connecting an arcuate ridge and an arcuate root to each other, with the suction delivery element, both end parts thereof being closely contacted and screwed with the helical part of the heat transfer tube, a scraping part for scraping off the process fluid attached to the inner wall of the heat transfer tube being provided in between the both end parts, and check valves being disposed in the both end parts, thereby the process fluid sucked into the inside of the heat transfer tube flowing into the inside of the suction delivery element from one end part, and flowing out from another end part into the inside of the heat transfer tube, the process fluid, having flown out into the inside of the heat transfer tube, being forced out to the outside of the heat transfer tube by the another end part with a reciprocating motion of the suction delivery element being made.

[2] A scrape-off type heat exchanger, the scrape-off type heat exchanger passing a heating/cooling medium in between a tubular jacket and a heat transfer tube, the heat transfer tube being extended in the inside of the jacket, and the scrape-off type heat exchanger passing a process fluid through the inside of the heat transfer tube to perform heat exchange between the process fluid and the heating/cooling medium, while scraping off the process fluid attached to an inner wall of the heat transfer tube, including:

a suction delivery element, the suction delivery element being closely contacted with the inner wall of the heat transfer tube, and making a reciprocating motion in the inside of the heat transfer tube, while being rotated, to suck the process fluid into the heat transfer tube and deliver the process fluid from the heat transfer tube, while scraping off the process fluid, the heat transfer tube being a corrugated pipe, having an inner wall with a helical part, the helical part providing a female thread-like spiral geometry, being formed by alternately connecting an arcuate ridge and an arcuate root to each other, the heat transfer tube having a process fluid inlet part for introducing the process fluid at one end part, and having a process fluid outlet part for discharging the process fluid at another end part, with the suction delivery element, an intake end part, being located nearer to the process fluid inlet part, and a discharge end part, being located nearer to the process fluid outlet part, the intake end part and the discharge end part being closely contacted and screwed with the helical part of the heat transfer tube, and a scraping part for scraping off the process fluid attached to the inner wall of the heat transfer tube being provided in between the intake end part and the discharge end part, the intake end part having a check valve, the check valve allowing only flowing-in of the process fluid, the discharge end part having a check valve, the check valve allowing only flowing-out of the process fluid, the scraping part having a scraping blade with a shape allowing bringing about a close contact thereof with the face ranging from a ridge to a root of the helical part of the inner wall of the heat transfer tube, upon the suction delivery element being traveled from the process fluid inlet part side toward the process fluid outlet part, while being rotated, the suction delivery element sucking the process fluid into in between the process fluid inlet part and the intake end part, and forcing out the process fluid in between the discharge end part and the process fluid outlet part to the outside of the heat transfer tube from the process fluid outlet part, upon the suction delivery element being traveled from the process fluid outlet part side toward the process fluid inlet part, the suction delivery element taking in, from the intake end part, the process fluid, having been sucked in, and discharging, from the discharge end part, the process fluid, having been taken in, during the time when the suction delivery element being traveled, while being rotated, the scraping blade scraping off the process fluid from the inner wall of the heat transfer tube.

[3] The scrape-off type heat exchanger according to [1] or [2], wherein there is provided a rotating shaft, being extended along the center axis of the heat transfer tube, and being capable of being rotated in a normal or reverse direction by a motor, and the suction delivery element, through which the rotating shaft is penetrated, and varies in direction of traveling, depending upon the normal or reverse rotation of the rotating shaft.

[4] The scrape-off type heat exchanger according to any one of [1] to [3], wherein the suction delivery element has an overall length equal to or less than one half of the overall length of the heat transfer tube.

[5] The scrape-off type heat exchanger according to any one of [1] to [4], wherein a plurality of heat transfer tubes, being each extended in the inside of the jacket, and having the suction delivery element, are connected in series.

The present invention provides the following function.

In the case where the scrape-off type heat exchanger (1) is used to perform heat exchange, a heating medium or a cooling medium (hereinafter, to be called "heating/cooling medium") is caused to flow in between the jacket (10) and the heat transfer tube (20), which is extended in the inside of the jacket (10). The process fluid, which is to be subjected to heat exchange with this heating/cooling medium, is introduced into the inside of the heat transfer tube (20) from the process fluid inlet part (21), which is provided at one end part of the heat transfer tube (20).

When this process fluid is to be introduced, the suction delivery element (30) is driven which is closely contacted with the inner wall (200) of the heat transfer tube (20), and makes a reciprocating motion in the inside of the heat transfer tube (20), while being rotated. When the suction delivery element (30) is traveled from the process fluid inlet part (21) side toward the process fluid outlet part (22), while being rotated, a negative pressure is generated across the process fluid inlet part (21) and the intake end part (31), which is one end part of the suction delivery element (30), because the suction delivery element (30) and the inner wall (200) of the heat transfer tube (20) are closely contacted with each other, thereby the process fluid being sucked into the inside of the heat transfer tube (20) from the process fluid inlet part (21).

At this time, the process fluid that exists between the discharge end part (32), which is another end part of the suction delivery element (30), and the process fluid outlet part (22) of the heat transfer tube (20) is forced out from the process fluid outlet part (22) to the outside of the heat transfer tube (20), being pushed by the discharge end part (32) of the suction delivery element (30). At the discharge end part (32), the check valve (320) is provided, and thus the discharge end part (32) pushing the process fluid will not cause the process fluid to flow backward into the inside of the suction delivery element (30).

Next, when the suction delivery element (30) is traveled from the process fluid outlet part (22) side toward the process fluid inlet part (21), while being rotated, the process fluid that has been sucked into in between the process fluid inlet part (21) and the intake end part (31) of the suction delivery element (30) in the way as described above is pushed by the intake end part (31). In the intake end part (31), the check valve (310) is provided, and thus the intake end part (31) pushing the process fluid will cause the process fluid to be taken in into the inside of the suction delivery element (30) through the check valve (310).

The process fluid that has been taken in into the inside of the suction delivery element (30) is pushed by the process fluid that is taken in thereafter in succession, thereby being forced out into the inside of the heat transfer tube (20) through the check valve (320) that is provided in the discharge end part (32). During the time when the suction delivery element (30) is traveled, while being rotated, the scraping part that is provided in between the intake end part (31) and the discharge end part (32) continues to scrape off the process fluid that is attached to the inner wall (200) of the heat transfer tube (20).

In this way, the suction delivery element (30) that is closely contacted with the inner wall (200) of the heat transfer tube (20) makes a reciprocating motion in the inside of the heat transfer tube (20), whereby the process fluid can be sucked and introduced into the inside of the heat transfer tube (20), and the process fluid that has been subjected to heat exchange with the heating/cooling medium can be discharged from the heat transfer tube (20).

Thus, there is no need for using a pressure pump for introducing the process fluid into the inside of the heat transfer tube (20), whereby the construction of the scrape-off type heat exchanger (1) can be made simple, whereby reduction of the manufacturing cost can be achieved.

The heat transfer tube (20) has an inner wall (200) with a helical part (210) which provides a female thread-like geometry, being formed by alternately connecting an arcuate ridge (211) and an arcuate root (212) to each other; with the suction delivery element (30), the disk-like intake end part (31), which is located nearer to the process fluid inlet pipe (21), and the disk-like discharge end part (32), which is located nearer to the process fluid outlet pipe (22), are closely contacted and screwed with the helical part (210) of the heat transfer tube (20); and the scraping part is adapted to be the scraping blade (331) having a shape that allows bringing about a close contact thereof with the face ranging from the ridge (211) to the root (212) of the helical part (210) of the inner wall (200) of the heat transfer tube (20), whereby traveling of the suction delivery element (30) and the operation of scraping off the process fluid by the scraping blade (331) are made smooth and effective.

The suction delivery element (30) is penetrated by the rotating shaft (23), which is extended along the center axis of the heat transfer tube (20), this rotating shaft (23) being rotated by the motor (M). The suction delivery element is not fixed to the rotating shaft (23), and thus with the rotating shaft (23) being rotated, the intake end part (31) and the discharge end part (32), which are closely contacted and screwed with the helical part (210) of the heat transfer tube (20), are traveled in the inside of the heat transfer tube (20), while being rotated. The direction of traveling varies depending upon the direction of rotation which is transmitted by the rotating shaft (23).

The suction delivery element (30) can cause the process fluid to be effectively traveled, if the overall length thereof is equal to or less than one half of the overall length of the heat transfer tube (20).

A plurality of suction delivery elements (30) that are each extended in the inside of the jacket (10), having the heat transfer tube (20), can also be connected in series. In this case, the process fluid that has been discharged from the heat transfer tube (20) that is disposed upstream is pushed to be introduced into the heat transfer tube (20) on the downstream side, and the suction delivery element that is traveled in the inside of the heat transfer tube (20), being disposed downstream, is operated in the same way as described above to suck the process fluid into the inside of the heat transfer tube (20). The subsequent function is the same as that described above.

Advantages of the Invention

With the scrape-off type heat exchanger in accordance with the present invention, the suction delivery element that is traveled in the inside of the heat transfer tube makes sucking and introducing of the process fluid into the inside of the heat transfer tube, and discharging the process fluid from the inside of the heat transfer tube, whereby there is no need for providing a pressure pump for forcibly feeding the process fluid into the heat transfer tube, and thus the construction can be made simple, whereby reduction of the manufacturing cost can be achieved.

MODES FOR CARRYING OUT THE INVENTION

Hereinbelow, an exemplary embodiment of the present invention will be explained with reference to the drawings.

Each drawing illustrates the embodiment of the present invention.

Figure 1:
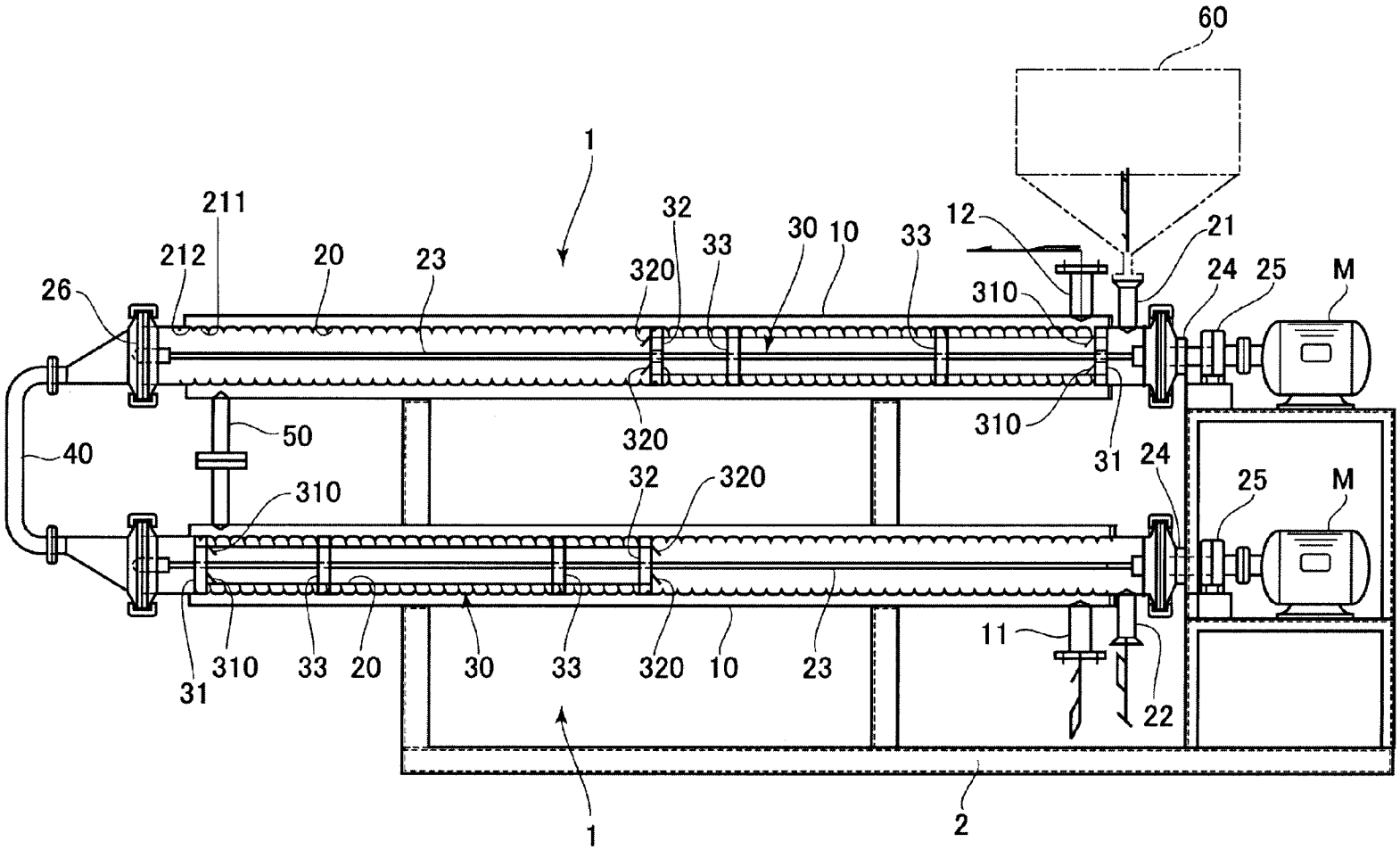
FIG. 1 is a perspective view showing a scrape-off type heat exchanger according to an embodiment of the present invention.

A scrape-off type heat exchanger 1 shown as an example in FIG. 1 is a scrape-off type heat exchanger for heating or cooling a process fluid, such as a high viscosity fluid or slurry fluid. Process fluids include foodstuffs, such as ketchup, mayonnaise, sweet bean paste, edible creams and ice cream, and cosmetics, such as those which are creamy in texture. With the scrape-off type heat exchanger 1, a heat transfer tube 20 is extended in a tubular jacket 10. In the inside of the heat transfer tube 20, a later described suction delivery element 30 is disposed.

In FIG. 1 as an example, two scrape-off type heat exchangers 1 are connected in series, being disposed on a mounting frame 2 in upper and lower two stages. The end parts of the heat transfer tubes 20 of the scrape-off type heat exchanger 1 at the upper stage and the scrape-off type heat exchanger 1 at the lower stage are communicated with each other by a process fluid communication pipe 40. The number of scrape-off type heat exchangers 1 is not limited to two, but three or more scrape-off type heat exchangers 1 may be connected in series. Further, they need not be connected in upper and lower two stages, but may be connected in multiple stages in a horizontal direction. Further, instead of connecting a plurality of them, a single scrape-off type heat exchanger 1 may be disposed. In the case where the scrape-off type heat exchanger 1 is used as a single unit, a process fluid outlet pipe 22 is provided in place of a process fluid communication pipe 40, which is provided at the end part on the side opposite to the end part at which a process fluid inlet pipe 21 is provided.

The scrape-off type heat exchanger 1 at the upper stage and the scrape-off type heat exchanger 1 at the lower stage are connected to each other also by a heating/cooling medium communication pipe 50, which connects between the clearances formed in between the heat transfer tube 20 and the jacket 10 of the respective scrape-off type heat exchangers 1. The clearance formed in between the heat transfer tube 20 and the jacket 10 is used for passing a heating medium, such as hot water or steam, or a cooling medium, such as water or Freon (hereinafter, to be collectively called a "heating/cooling medium").

At the end part of the jacket 10 for the scrape-off type heat exchanger 1 at the lower stage, a heating/cooling medium inlet pipe 11 for injecting the heating/cooling medium is provided. Further, at the end part of the jacket for the scrape-off type heat exchanger 1 at the upper stage, a heating/cooling medium outlet pipe 12 for discharging the heating/cooling medium is provided.

In the vicinity of this heating/cooling medium outlet pipe 12, the process fluid inlet pipe 21 for introducing the process fluid into the heat transfer tube 20 is provided at the end part of the heat transfer tube 20. On this process fluid inlet pipe 21, a hopper 60 for charging the process fluid is mounted. On the other hand, in the vicinity of the heating/cooling medium inlet pipe 11 for the scrape-off type heat exchanger 1 at the lower stage, the process fluid outlet pipe 22 for discharging the process fluid from the inside of the heat transfer tube 20 is provided at the end part of the heat transfer tube 20.

The heat transfer tube 20 is a corrugated pipe, having an inner wall 200 with a helical part 210 which provides a female thread-like spiral geometry, being formed by alternately connecting an arcuate ridge 211 and an arcuate root 212 to each other. In the inside of the heat transfer tube 20, a rotating shaft 23 is extended along the center axis of the heat transfer tube 20. To the end part of the heat transfer tube 20 at which the process fluid inlet pipe 21 is provided, a shaft sealing device 24, such as a mechanical seal, is mounted.

Outside of this shaft sealing device 24, there is disposed a thrust bearing 25 for supporting the rotating shaft 23. The rotating shaft 23, which is supported by the thrust bearing 25, is connected to the drive shaft of a motor M, which can be rotated in normal and reverse directions. At another end part of the heat transfer tube 20, there is disposed a bushing-type rotational bearing 26, which supports one end part of the rotating shaft 23.

Inside of the heat transfer tube 20, there is disposed the suction delivery element 30, which is rotated, being closely contacted with the inner wall 200 of the heat transfer tube 20, while making a reciprocating motion. The suction delivery element 30 is provided by connecting between a disk-like intake end part 31, which is located nearer to the process fluid inlet pipe 21, and a disk-like discharge end part 32, which is located nearer to the process fluid outlet pipe 22. The intake end part 31 and the discharge end part 32 are connected to each other by means of, for example, a plurality of shafts (not shown). The distance between the intake end part 31 and the discharge end part 32 is exemplified in FIG. 1 as one half of the overall length of the heat transfer tube 20, however, may be shorter than that.

At a plurality of places in between the intake end part 31 and the discharge end part 32, there is disposed a scraping part 33, which scrapes off the process fluid attached to the inner wall 200 of the heat transfer tube 20. At least one scraping part 33 need to be disposed in between the intake end part 31 and the discharge end part 32.

Figure 2:
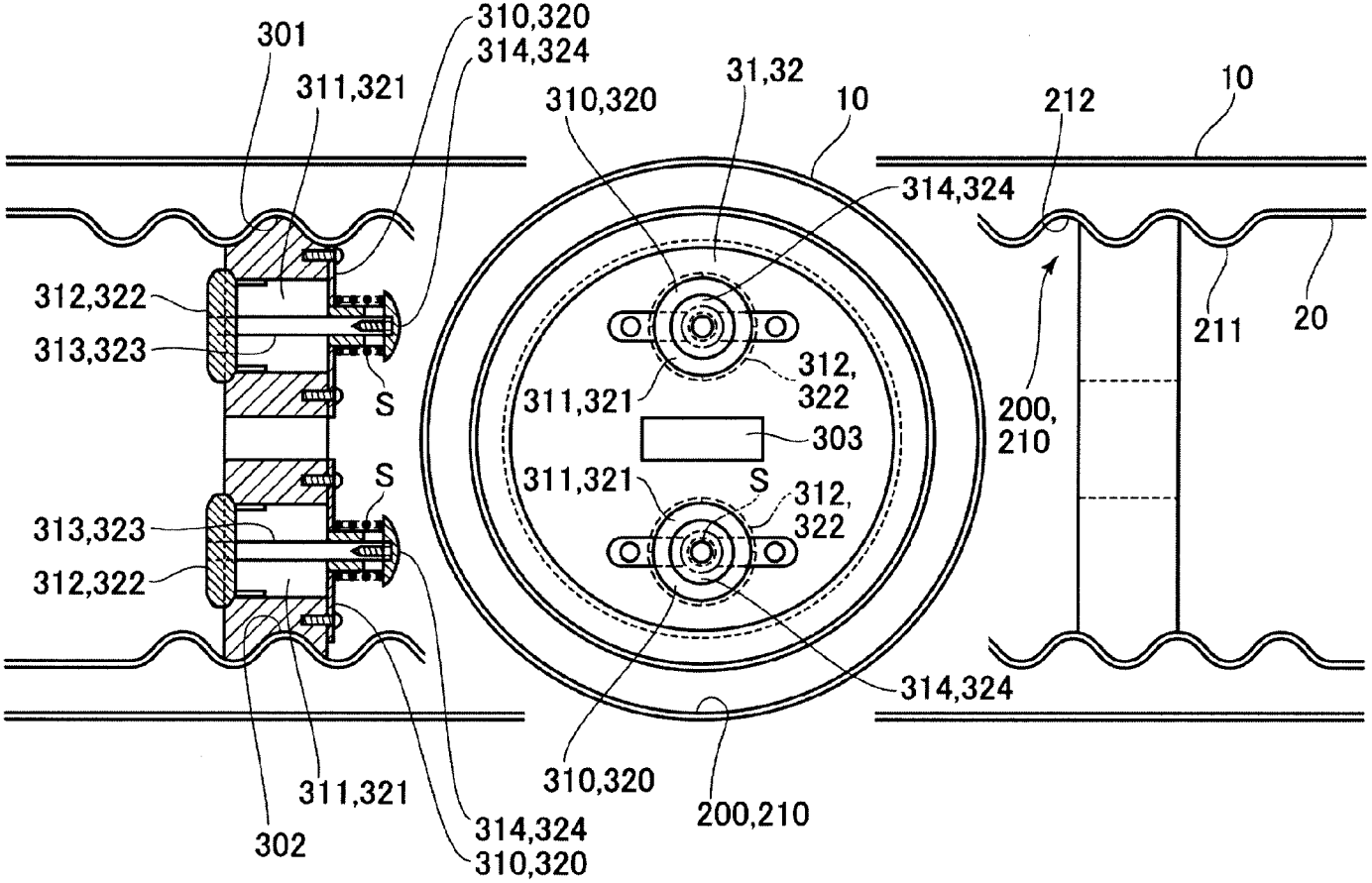
FIG. 2 is an explanatory drawing for explaining an intake end part and a discharge end part constituting a suction delivery element in FIG. 1.
Figure 3:
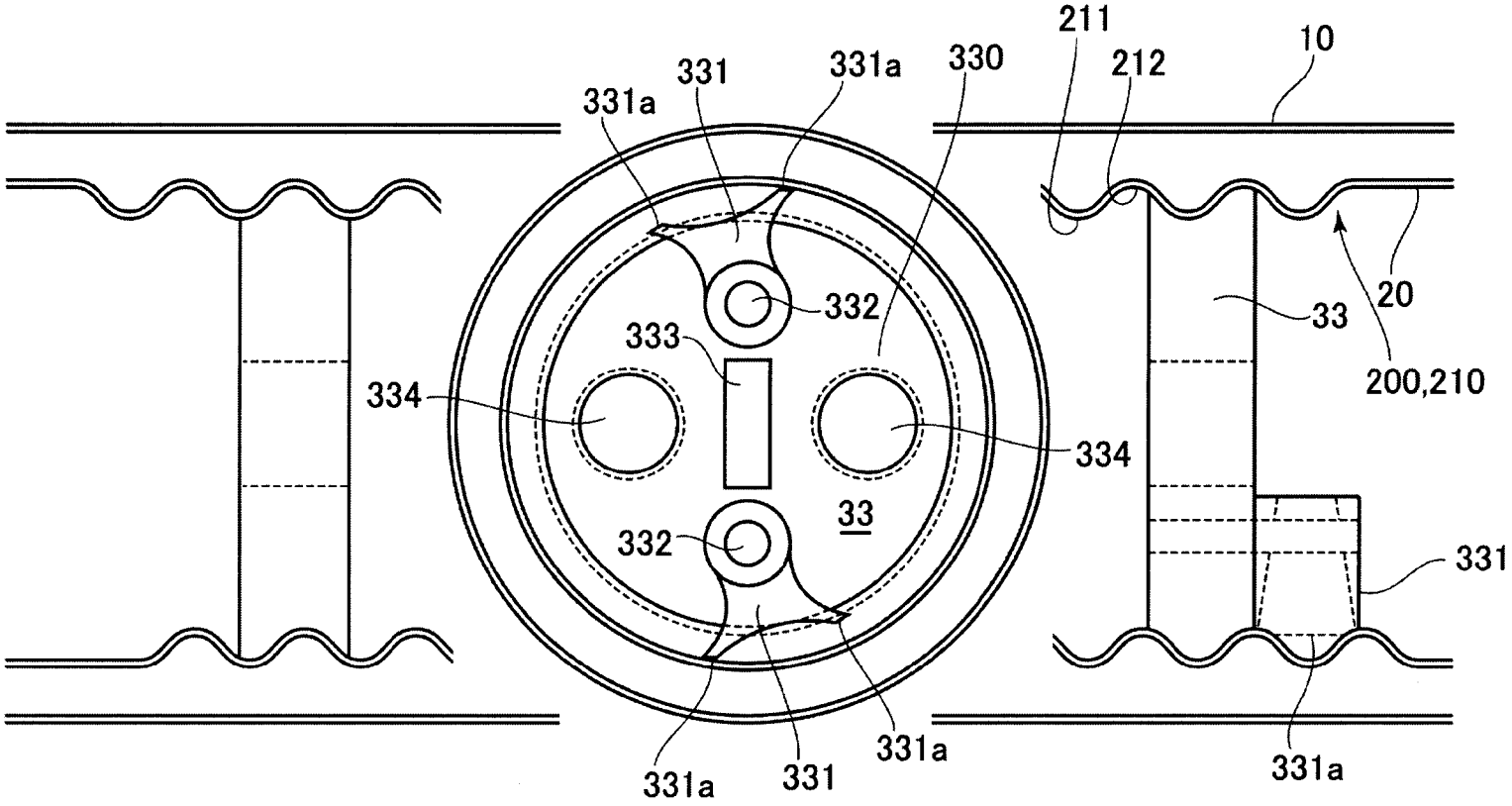
FIG. 3 is an explanatory drawing for explaining a scraping part constituting the suction delivery element in FIG. 1.

As shown in FIG. 2, the intake end part 31 and the discharge end part 32 are formed in the shape of a thick disk, being made of, for example, a metal. The intake end part 31 and the discharge end part 32 are each formed in the shape which causes the outer peripheral surface thereof to be closely contacted and screwed with the helical part 210 of the heat transfer tube 20. In other words, a ridge 301 and a root 302, which are the same as the ridge 211 and the root 212 in the helical part 210, are alternatively connected to each other to provide a male-thread like spiral geometry. The close contact condition between the intake end part 31 and the helical part 210 of the heat transfer tube 20 and between the discharge end part 32 and the helical part 210 of the same is maintained, even if a slight clearance should be generated therebetween, by the process fluid, which is highly viscous, getting in the clearance. In the respective central portions of the intake end part 31 and the discharge end part 32, a rotating shaft through-hole 303 in the shape of a rectangle is provided.

In this rotating shaft through-hole 303, the rotating shaft 23 as mentioned above is inserted. The rotating shaft 23 has the same sectional shape as the shape of the rotating shaft through-hole 303 at least in the range in which the intake end part 31 and the discharge end part 32 are traveled. Therefore, the rotating shaft 23 is capable of transmitting the rotation thereof to the intake end part 31 and the discharge end part 32 without running idle in between the intake end part 31 and the discharge end part 32. In addition, the rotating shaft 23 only penetrates through the intake end part 31 and the discharge end part 32, being not fixed to the intake end part 31 and the discharge end part 32, and therefore, the intake end part 31 and the discharge end part 32 can be traveled along the rotating shaft 23, while being rotated by the rotating force of the rotating shaft 23. In other words, the suction delivery element 30 can be traveled along the rotating shaft 23, while being rotated in the inside of the heat transfer tube 20. The shape of the rotating shaft through-hole 303 and the shape of the portion of the rotating shaft 23 that penetrates through the rotating shaft through-hole 303 are not limited to a rectangular shape shown in the figure, and may be any shape, so long as the rotating shaft 23, which penetrates through the rotating shaft through-hole 303, is not run idle.

The intake end part 31 is provided with a check valve 310. Further, the discharge end part 32 is provided with a check valve 320 in the same way.

The check valve 310 has a disk valve 312 and a coil spring S for plugging up a check valve through-hole 311, which is provided in the intake end part 31. At the center of the disk valve 312, a stem 313, which has an overall length longer than that of the check valve through-hole 311, is extended, and at the end part of the stem 313, a stopper 314 is provided. The diameter of the stem 313 is smaller than the diameter of the coil spring S, which is wound around the stem 313, being compressed. The stopper 314 has a shape and a size that prevent the coil spring S wound around the stem 313 from coming off. The discharge end part 32 is also provided with a check valve through-hole 321, which is the same as the check valve through-hole 311. With the check valve 320, as with the check valve 310, a stem 323, having a stopper 324, is extended from the disk valve 322, a coil spring S being wound around a stem 323, being compressed.

The check valve 310 allows only the process fluid upstream of the suction delivery element 30 to flow into the inside of the suction delivery element 30, thus preventing the process fluid in the inside of the suction delivery element 30 from flowing backward to the upstream side of the suction delivery element 30. Further, the check valve 320 allows only the process fluid taken in into the suction delivery element 30 to flow out to the downstream side of the suction delivery element 30, thus preventing the process fluid in the outside of the suction delivery element 30 from flowing backward into the inside of the suction delivery element 30.

The scraping part 33, which is provided in between the intake end part 31 and the discharge end part 32, has a disk-like rotator 330, which, as with the intake end part 31 and the discharge end part 32, is formed in the shape which causes the outer peripheral surface thereof to be closely contacted and screwed with the helical part 210 of the heat transfer tube 20. In this rotator 330, a scraping blade 331 for scraping off the process fluid attached to the helical part 210 of the heat transfer tube 20 is pivotally supported by a pivotal shaft 332 in a freely rockable manner.

The scraping blade 331 is bifurcated to provide scraping tip end parts 331*a*, 331*a*. The scraping tip end parts 331*a*, 331*a* extend in directions which brought about a head and trail positional relationship between them with respect to a specific direction of rotation of the scraping part 33. These scraping tip end parts 331*a*, 331*a* have a geometry which brings about a contact of them with the face ranging from the ridge 211 to the root 212 of the helical part 210, in other words, a geometry which brings about a close contact of them with the face of the helical part 210 for any tangential direction thereof. The scraping blade 331 is freely rockable, thereby being capable of taking either the state in which the scraping tip end part 331*a* is contacted with the entire face ranging from the ridge 211 to the root 212, or the state in which the scraping tip end part 331*a* is separated from the face ranging from the ridge 211 to the root 212. Of the two scraping tip end parts 331*a*, 331*a*, that which is at the head with respect to a given direction of rotation of the scraping part 33 is closely contacted with the face ranging from the ridge 211 to the root 212.

In the rotator 330, a rotating shaft through-hole 333 is provided which is the same as that of the rotating shaft through-hole 303, which is provided in the central portion of the intake end part 31 and the discharge end part 32, and the rotating shaft 23 is penetrated through the rotating shaft through-hole 333. Further, in the rotator 330, there are provided flow holes 334, through which the process fluid can pass.

The same scrape-off type heat exchanger 1 as the scrape-off type heat exchanger 1 which is thus configured is disposed at the lower stage of the mounting frame 2, these being communicated with each other by the process fluid communication pipe 40, thereby the process fluid forced out from the scrape-off type heat exchanger 1 at the upper stage being taken in into the scrape-off type heat exchanger 1 at the lower stage. The process fluid taken in into the scrape-off type heat exchanger 1 at the lower stage is subjected to heat exchange, while being traveled in the same way as when having been passed through the scrape-off type heat exchanger 1 at the upper stage.

The process fluid, which has been subjected to heat exchange by the scrape-off type heat exchanger 1 at the lower stage, is discharged from the process fluid outlet pipe 22 to the outside of the scrape-off type heat exchanger 1. Further, a circulation pipeline (not shown) is disposed such that the heating/cooling medium which flows into the heating/cooling medium inlet pipe 11 of the scrape-off type heat exchanger 1 at the lower stage and flows out from the heating/cooling medium outlet pipe 12 of the scrape-off type heat exchanger 1 at the upper stage is again caused to flow into the scrape-off type heat exchanger 1 at the lower stage from the heating/cooling medium inlet pipe 11 at the lower stage.

Next, the function of the scrape-off type heat exchanger 1 will be explained.

Heat exchange of the process fluid by the scrape-off type heat exchanger 1 is performed with the heating/cooling medium through the heat transfer tube 20, the heating/cooling medium being passed in between the jacket 10 and the heat transfer tube 20, which is extended in the jacket 10. The heating/cooling medium gets in into the scrape-off type heat exchanger 1 from the heating/cooling medium inlet pipe 11, which is provided on one end side of the scrape-off type heat exchanger 1 at the lower stage, being passed through the heating/cooling medium communication pipe 50, which is provided on the other end side, and being caused to get in into one end side of the scrape-off type heat exchanger 1 at the upper stage. The heating/cooling medium, which has got in into the scrape-off type heat exchanger 1 at the upper stage, gets out of the scrape-off type heat exchanger 1 at the upper stage from the heating/cooling medium outlet pipe 12 provided on the other end side of the scrape-off type heat exchanger 1, passing through a circulation pipeline (not shown), and again getting in into the scrape-off type heat exchanger 1 from the heating/cooling medium inlet pipe 11 of the scrape-off type heat exchanger 1 at the lower stage. The heating/cooling medium is thus circulated.

The process fluid, which is subjected to heat exchange with this heating/cooling medium is charged into the hopper 60, which is mounted on the process fluid inlet pipe 21 of the scrape-off type heat exchanger 1, which is disposed at the upper stage of the mounting frame 2. With the motor M being driven to rotate the rotating shaft 23, the suction delivery element 30 is rotated by the rotation of the rotating shaft 23, while being traveled in the inside of the heat transfer tube 20.

The intake end part 31 of the suction delivery element 30 is traveled from where it is in the vicinity of the process fluid inlet pipe 21 toward the side of the end part where the process fluid communication pipe 40 is connected, a negative pressure is generated in the space ranging from the process fluid inlet pipe 21 to the intake end part 31 with the suction delivery element 30 being traveled, because the respective outer peripheral surfaces of the intake end part 31 and the discharge end part 32 of the suction delivery element 30 are in close contact with the inner wall 200 of the helical part 210 of the heat transfer tube 20. This negative pressure causes the process fluid having a high viscosity to be sucked into the heat transfer tube 20. The suction of the process fluid is continued until the suction delivery element 30 reaches the end part where the process fluid communication pipe 40 is connected.

Next, when the suction delivery element 30 is returned to the process fluid inlet pipe 21 side, the intake end part 31 of the suction delivery element 30 will push the process fluid, which has been sucked into the inside of the heat transfer tube 20. When the intake end part 31 pushes the process fluid, the check valve 310, which is provided in the intake end part 31, and has been brought into a closed state by the resilient force of the coil spring S, is brought into an open state, being pushed by the process fluid, thereby the process fluid being taken in into the inside of the suction delivery element 30 through the check valve 310.

Next, when the suction delivery element 30 is again traveled toward the end part side where the process fluid communication pipe 40 is connected, the process fluid is sucked into the inside of the heat transfer tube 20 in the same way as described above. Next, when the suction delivery element 30 is again returned toward the process fluid inlet pipe 21 side, the process fluid is taken in into the inside of the suction delivery element 30 in the same way as described above.

At this time, the process fluid which is newly taken in pushes the process fluid which has been taken in into the suction delivery element 30 at the previous step, the check valve 320, which is provided in the discharge end part 32 of the suction delivery element 30, and has been brought into a closed state by the resilient force of the coil spring S, is brought into an open state, thereby the process fluid being forced out, through the check valve 320, into the inside of the heat transfer tube 20 that is in the outside of the suction delivery element 30.

Next, when the suction delivery element 30 is again traveled toward the process fluid communication pipe 40 side, the process fluid is sucked and introduced into the heat transfer tube 20 from the process fluid inlet pipe 21 in the same way as described above, and at the same time, the process fluid, which, at the previous step, has been forced out in between the end part of the heat transfer tube 20 at which the process fluid communication pipe 40 is connected and the discharge end part 32 of the suction delivery element 30, is forced out to the outside of the heat transfer tube 20 from the process fluid communication pipe 40, being pushed by the discharge end part 32. At this time, because the check valve 320 is provided for the discharge end part 32, the process fluid will not flow backward into the suction delivery element 30 with the discharge end part 32 pushing the process fluid.

From this time on, every time the suction delivery element 30 makes a reciprocating motion, the process fluid is sucked and introduced into the heat transfer tube 20, which is then followed by the process fluid being forced out from the heat transfer tube 20 into the process fluid communication pipe 40. Thus, the suction delivery element 30, which is closely contacted with the inner wall 200 of the heat transfer tube 20, makes a reciprocating motion in the heat transfer tube 20, whereby the process fluid can be sucked and introduced into the heat transfer tube 20, and the process fluid, which has been subjected to heat exchange with the heating/cooling medium, can be discharged from the heat transfer tube 20 to be delivered to the scrape-off type heat exchanger 1 at the lower stage through the process fluid communication pipe 40.

While the suction delivery element 30 is traveled as described above, the scraping blade 331, being provided in the scraping part 33, continues to scrape off the process fluid attached to the helical part 210 of the heat transfer tube 20. The scraping blade 331 is pivotally supported by the pivotal shaft 332 in a freely rockable manner, and thus with the suction delivery element 30 being traveled while being rotated, the side face of the scraping blade 331 that is at the head with respect to the direction of rotation of the scraping part 33 is caused to be pressed against the process fluid attached to the helical part 210.

Thus, with the scraping blade 331 being pivoted, the scraping tip end parts 331*a* that is at the head with respect to the direction of rotation of the scraping part is brought into the state in which it is closely contacted with the face ranging from the ridge 211 to the root 212 of the helical part 210. Thereby, the process fluid that is attached to the helical part 210 and is on the head side with respect to the direction of rotation of the scraping part 33 is scraped off by the scraping blade 331. When the direction of traveling of the suction delivery element 30 is reversed, i.e., the direction of rotation of the scraping part 33 is reversed, the scraping tip end part 331*a* that has been in close contact with the face of the helical part 210 up to that time is separated from the face of the helical part 210, and another scraping tip end part 331*a* that is to be at the head with respect to the direction of rotation of the scraping part 33 is brought into a close contact with the face of the helical part 210.

The scrape-off type heat exchanger 1 at the upper stage and the scrape-off type heat exchanger 1 at the lower stage are synchronized with each other in traveling direction of the respective suction delivery elements 30, and the suction delivery element 30 of the scrape-off type heat exchanger 1 at the lower stage is traveled in the inside of the heat transfer tube 20 in synchronization with the process fluid that has been forced out by the suction delivery element 30 of the scrape-off type heat exchanger 1 at the upper stage being charged into the heat transfer tube 20 of the scrape-off type heat exchanger 1 at the lower stage through the process fluid communication pipe 40. In other words, in synchronization with the suction delivery element 30 of the scrape-off type heat exchanger 1 at the upper stage being traveled from right to left on the paper surface in FIG. 1, the suction delivery element 30 of the scrape-off type heat exchanger 1 at the lower stage will be traveled from left to right in the inside of the heat transfer tube 20. Therefore, the process fluid that has been forced out into the inside of the heat transfer tube 20 of the scrape-off type heat exchanger 1 at the lower stage through the process fluid communication pipe 40 is easily sucked in and charged toward the central part of the heat transfer tube 20 under a negative pressure generated by the suction delivery element 30 being traveled from left to right.

Also with the scrape-off type heat exchanger 1 at the lower stage, as is the case as with the scrape-off type heat exchanger 1 at the upper stage, the suction delivery element 30 makes a reciprocating motion in the inside of the heat transfer tube 20, thereby the process fluid being sucked and introduced into the inside of the heat transfer tube 20, and being subjected to heat exchange with the heating/cooling medium, and the process fluid that has been subjected to heat exchange being discharged from the process fluid outlet pipe 22 of the heat transfer tube 20.

As described above, with the scrape-off type heat exchanger 1 according to the present embodiment, there is no need for using a pressure pump for introducing the process fluid into the inside of the heat transfer tube 20. Thereby, the construction of the scrape-off type heat exchanger 1 is simplified, whereby reduction of the manufacturing cost can be achieved.

DESCRIPTION OF SYMBOLS

M: motor
S: coil spring
1: scrape-off type heat exchanger
2: mounting frame
10: jacket
11: heating/cooling medium inlet pipe
12: heating/cooling medium outlet pipe
20: heat transfer tube
21: process fluid inlet part
22: process fluid outlet part
23: rotating shaft
24: shaft sealing device
25: thrust bearing
26: rotational bearing
30: suction delivery element
31: intake end part
32: discharge end part
33: scraping part
40: process fluid communication pipe
50: heating/cooling medium communication pipe
60: hopper
200: inner wall
210: helical part
211: ridge of helical part
212: root of helical part
301: ridge of respective intake end part and discharge end part
302: root of respective intake end part and discharge end part
303: rotating shaft through-hole
333: rotating shaft through-hole
310: check valve
320: check valve
311: check valve through-hole
321: check valve through-hole
312: disk valve
322: disk valve
313: stem
323: stem
314: stopper
324: stopper
330: rotator
331: scraping blade
331*a*: scraping tip end part
332: pivotal shaft
334: flow hole

The invention claimed is:

1. A heat exchanger, comprising:

a tubular jacket;

a first heat transfer tube disposed in the tubular jacket so that a heating/cooling medium flows between the tubular jacket and the first heat transfer tube, and a process fluid flows through the first heat transfer tube to perform heat exchange between the process fluid and the heating/cooling medium, while scraping off the process fluid attached to an inner wall of the first heat transfer tube; and a suction delivery element contacting with the inner wall of the first heat transfer tube, said first heat transfer tube having a helical part formed by alternately connecting an arcuate ridge and an arcuate root to each other, said suction delivery element including end parts contacting with the helical part of the first heat transfer tube, a scraping part disposed between the end parts for scraping off the process fluid attached to the inner wall of the first heat transfer tube, and check valves disposed in the end parts, thereby the process fluid flowing into the suction delivery element from one of the end parts, and flowing out from another of the end parts into the first heat transfer tube.

2. The heat exchanger according to claim 1, further comprising a rotating shaft extending along a center axis of the first heat transfer tube, said rotating shaft penetrating through the suction delivery element.

3. The heat exchanger according to claim 1, wherein said suction delivery element has an overall length equal to or less than one half of an overall length of said first heat transfer tube.

4. The heat exchanger according to claim 1, further comprising a second heat transfer tube disposed in the tubular jacket, and connected to the first heat transfer tube in series.

5. A heat exchanger, comprising:

a tubular jacket;

a first heat transfer tube disposed in the tubular jacket so that a heating/cooling medium flows between the tubular jacket and the first heat transfer tube, and a process fluid flows through the first heat transfer tube to perform heat exchange between the process fluid and the heating/cooling medium, while scraping off the process fluid attached to an inner wall of the first heat transfer tube; and a suction delivery element contacting with the inner wall of the first heat transfer tube, said first heat transfer tube having a helical part formed by alternately connecting an arcuate ridge and an arcuate root to each other, said first heat transfer tube having a process fluid inlet part for introducing the process fluid, and a process fluid outlet part for discharging the process fluid, said suction delivery element including an intake end part located close to the process fluid inlet part, and a discharge end part located close to the process fluid outlet part, said intake end part and said discharge end part contacting with the helical part of the first heat transfer tube, said suction delivery element further including a scraping part disposed between the intake end part and the discharge end part for scraping off the process fluid attached to the inner wall of the first heat transfer tube, said intake end part having a first check valve for allowing the process fluid to flow in the intake end part, said discharge end part having a second check valve for allowing the process fluid to discharge from the discharge end part, said scraping part having a scraping blade contacting with the helical part of the first heat transfer tube, said suction delivery element being configured to move from the process fluid inlet part toward the process fluid outlet part so that the suction delivery element sucks the process fluid in between the process fluid inlet part and the intake end part and discharges the process fluid from the process fluid outlet part, said suction delivery element being configured to move from the process fluid outlet part toward the process fluid inlet part so that the suction delivery element takes in the process fluid from the intake end part and discharges from the discharge end part.

6. The heat exchanger according to claim 5, further comprising a rotating shaft extending along a center axis of the first heat transfer tube, said rotating shaft penetrating through the suction delivery element.

7. The heat exchanger according to claim 5, wherein said suction delivery element has an overall length equal to or less than one half of an overall length of said first heat transfer tube.

8. The heat exchanger according to claim 5, further comprising a second heat transfer tube disposed in the tubular jacket, and connected to the first heat transfer tube in series.

* * * * *